US010543699B2

(12) United States Patent
Torigoe et al.

(10) Patent No.: US 10,543,699 B2
(45) Date of Patent: Jan. 28, 2020

(54) PRINTING APPARATUS

(71) Applicant: SEIKO EPSON CORPORATION, Tokyo (JP)

(72) Inventors: Yasuhide Torigoe, Matsumoto (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/747,726

(22) PCT Filed: Jul. 27, 2016

(86) PCT No.: PCT/JP2016/003461
§ 371 (c)(1),
(2) Date: Jan. 25, 2018

(87) PCT Pub. No.: WO2017/017951
PCT Pub. Date: Feb. 2, 2017

(65) Prior Publication Data

US 2019/0001715 A1 Jan. 3, 2019

(30) Foreign Application Priority Data

Jul. 29, 2015 (JP) ..... 2015-149343

(51) Int. Cl.
*B41J 15/16* (2006.01)
*B41J 15/04* (2006.01)
*B41J 11/50* (2006.01)

(52) U.S. Cl.
CPC ..... *B41J 15/16* (2013.01); *B41J 11/50* (2013.01); *B41J 15/048* (2013.01)

(58) Field of Classification Search
CPC ..... B41J 15/16; B41J 15/048; B41J 11/50
See application file for complete search history.

(56) References Cited

U.S. PATENT DOCUMENTS 4,832,244 A * 5/1989 Moriya ..... B41J 11/50 226/115
2012/0098190 A1* 4/2012 Nieda ..... B41J 11/0045 11/45

(Continued)

FOREIGN PATENT DOCUMENTS

EP 0743188 A1 11/1996
EP 2754559 A1 7/2014

(Continued)

OTHER PUBLICATIONS

International Search Report dated Oct. 25, 2016 for PCT/JP2016/003461.

(Continued)

*Primary Examiner* — Jason S Uhlenhake
(74) *Attorney, Agent, or Firm* — Workman Nydegger

(57) ABSTRACT

A printing apparatus includes a holding unit that holds a plurality of roll bodies, a transport device (100) which has a transport unit (110) that imparts a transport force by coming into contact with a medium (M), a pressing unit (120) which presses the medium (M) toward the transport unit (110), and an adjustment unit (140) which is able to adjust a pressing force on the medium (M) in each of a plurality of regions in a width direction, the transport device (100) is able to transport the plurality of mediums (M) in the transport direction (F) in a state of being lined up in the width direction, a printing unit which performs printing on the medium (M), and a control unit which controls the adjustment unit (140) such that pressing force on the medium (M) in the non-printing state is smaller than in the printing state.

14 Claims, 9 Drawing Sheets

(56) References Cited

U.S. PATENT DOCUMENTS

| | | | | |
|---|---|---|---|---|
| 2014/0035984 | A1 | 2/2014 | Mills et al. | |
| 2014/0193187 | A1* | 7/2014 | Ishizuka | B41J 13/00 400/618 |

FOREIGN PATENT DOCUMENTS

| | | | |
|---|---|---|---|
| JP | 2001-002275 | A | 1/2001 |
| JP | 2003-246529 | A | 9/2003 |
| JP | 2003-326781 | A | 11/2003 |
| JP | 2005-001293 | A | 1/2005 |

OTHER PUBLICATIONS

Supplementary European Search Report issued in Application No. 16830056 dated Feb. 8, 2019.

* cited by examiner

[Fig. 1]
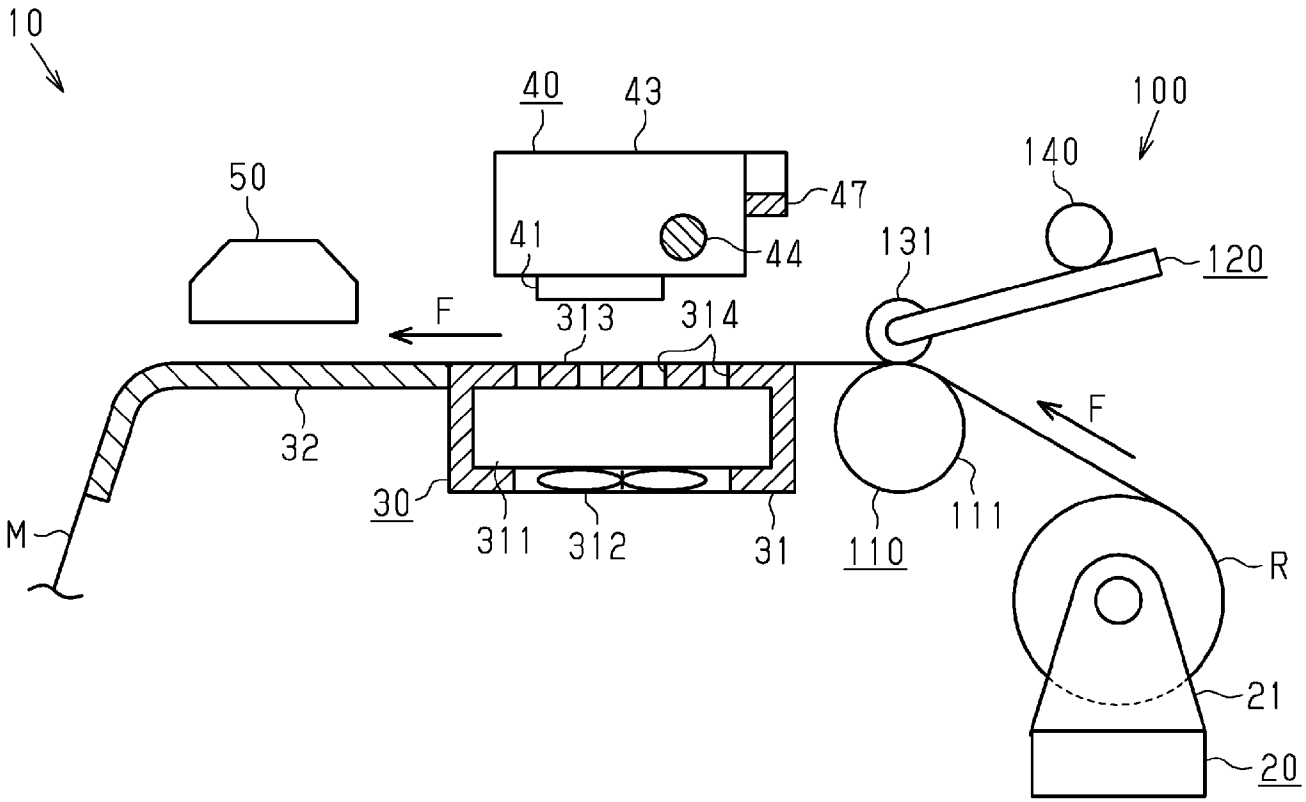

[Fig. 2]
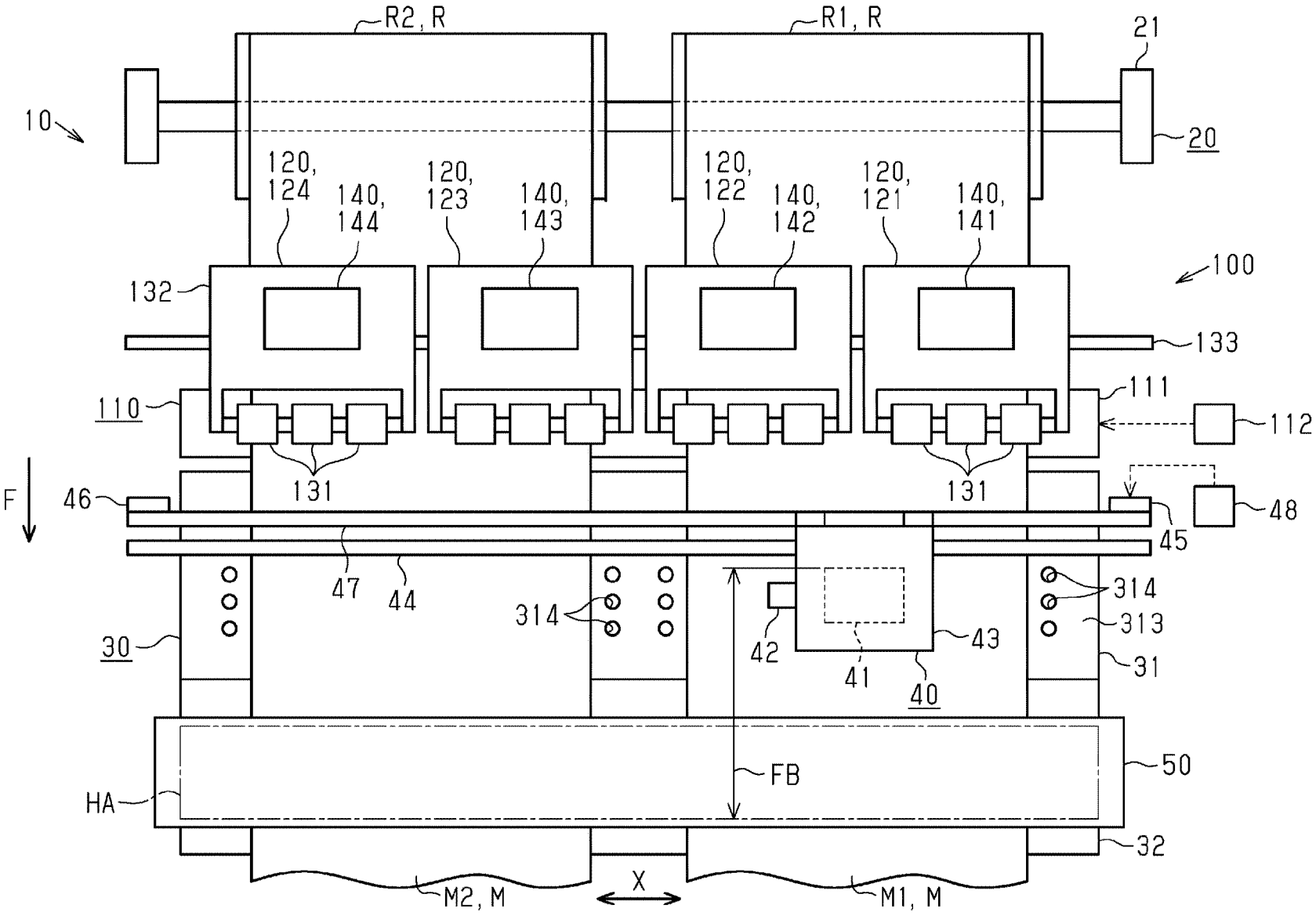

[Fig. 3]
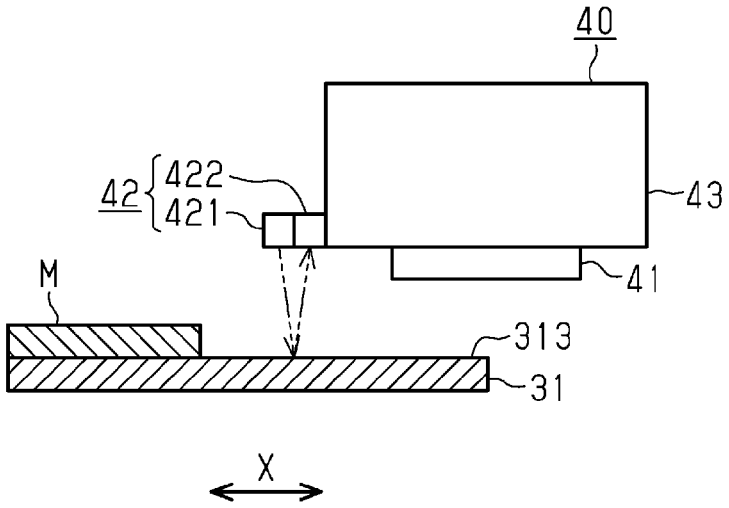
[Fig. 4]
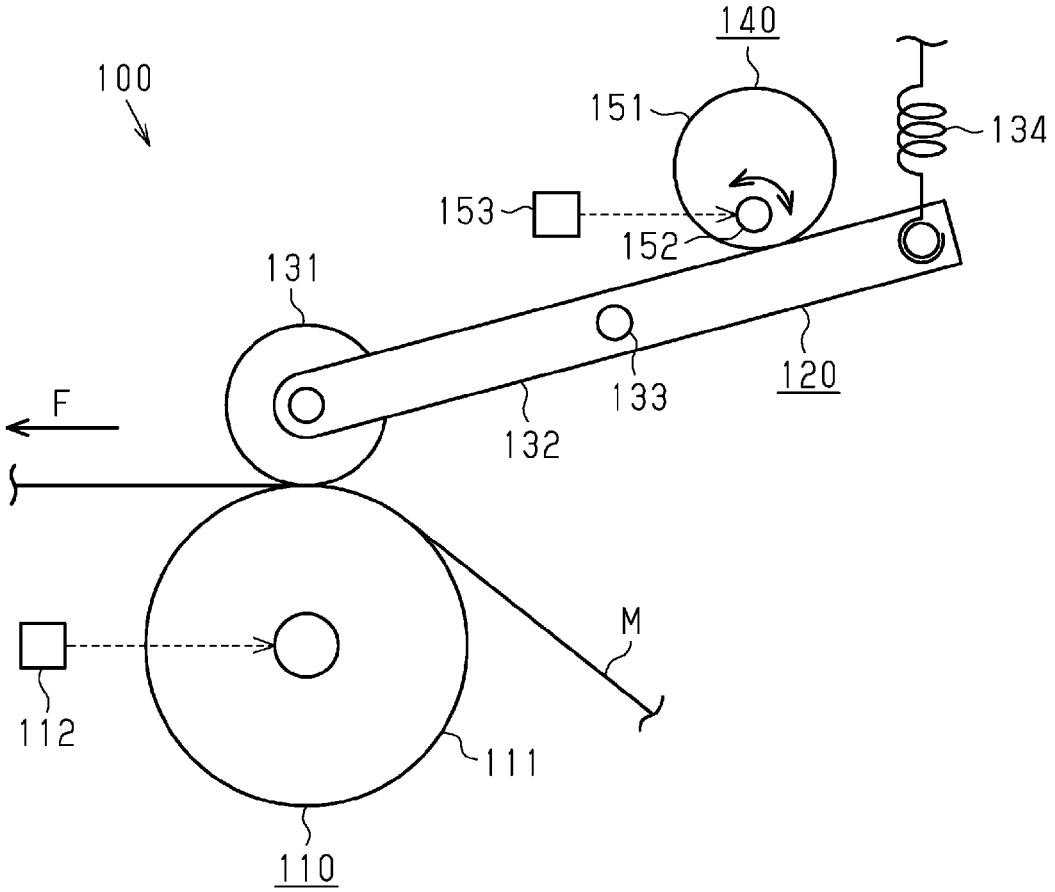

[Fig. 5]
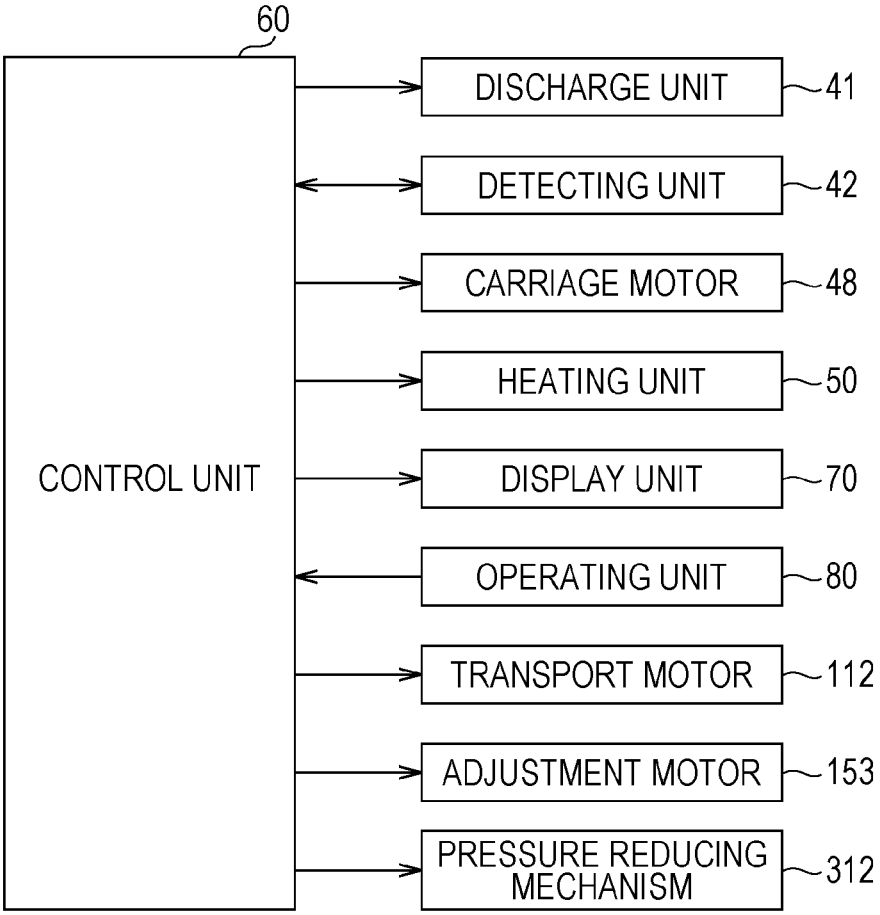

[Fig. 6]
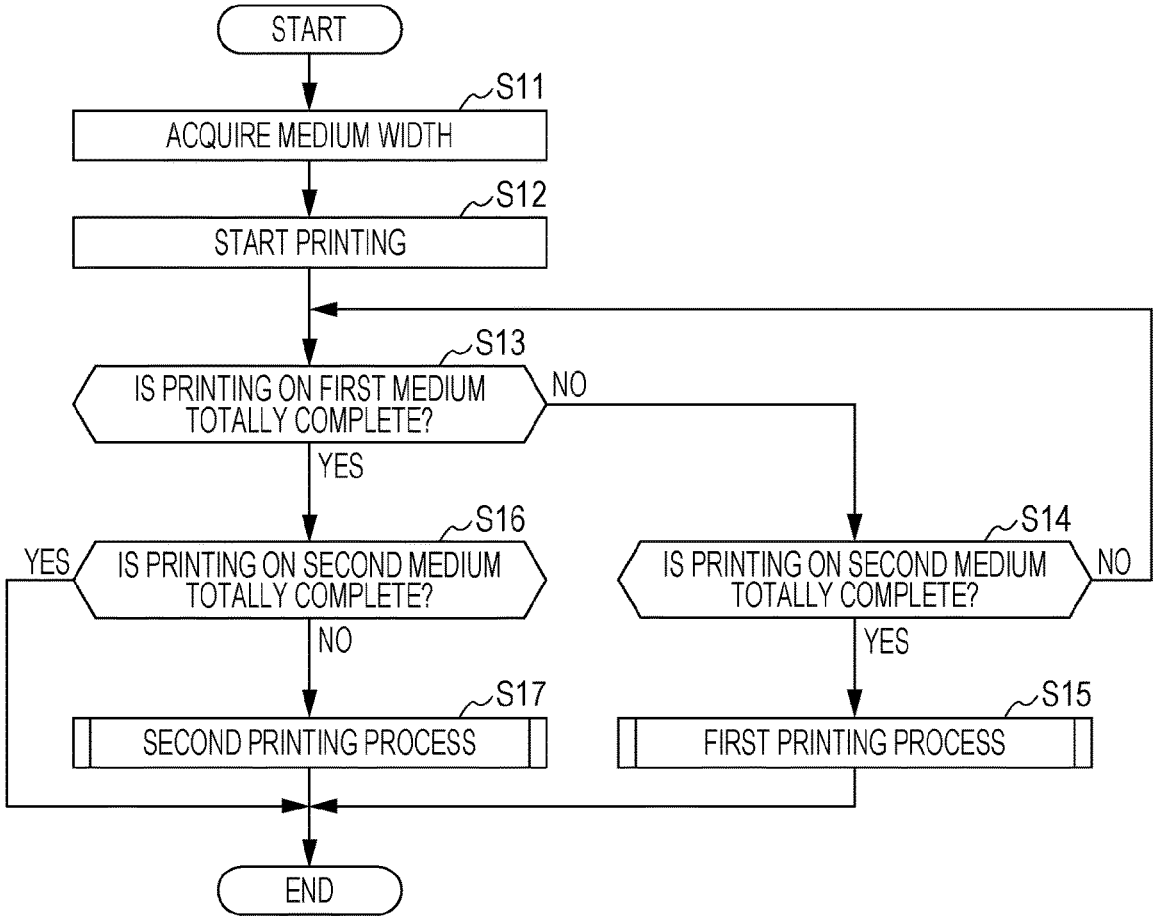

[Fig. 7]
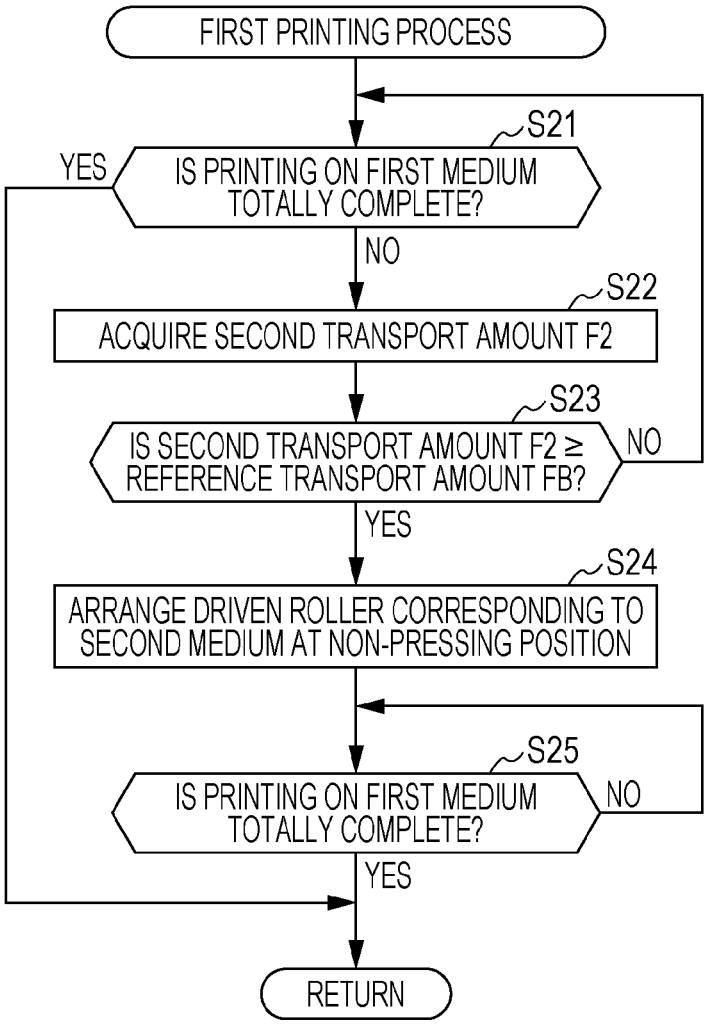

[Fig. 8]
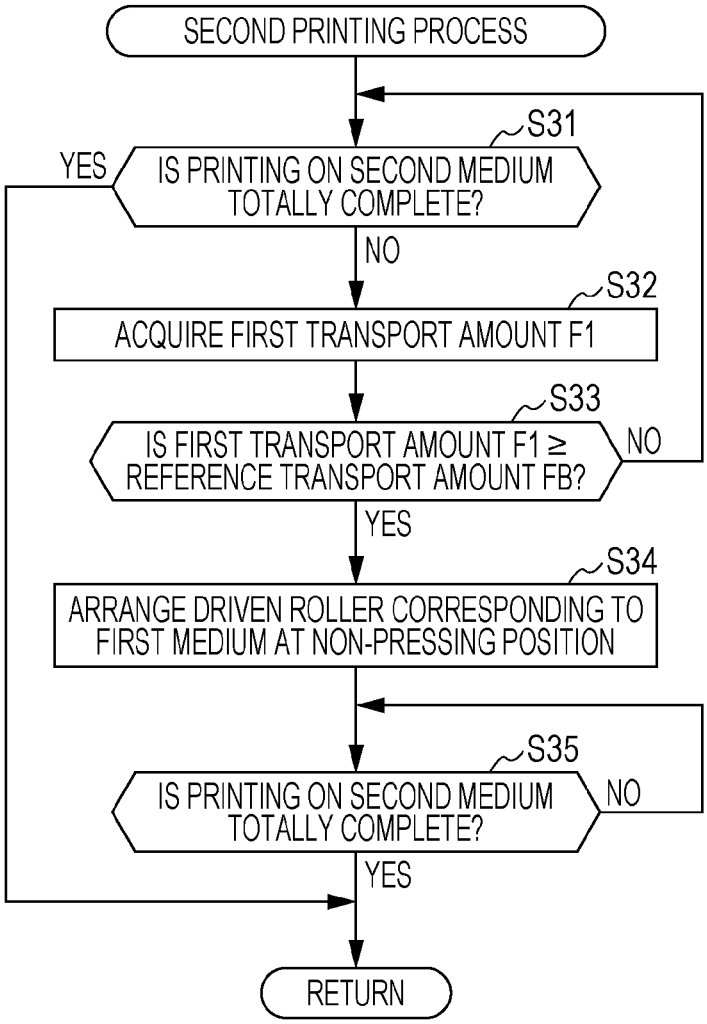

[Fig. 9]
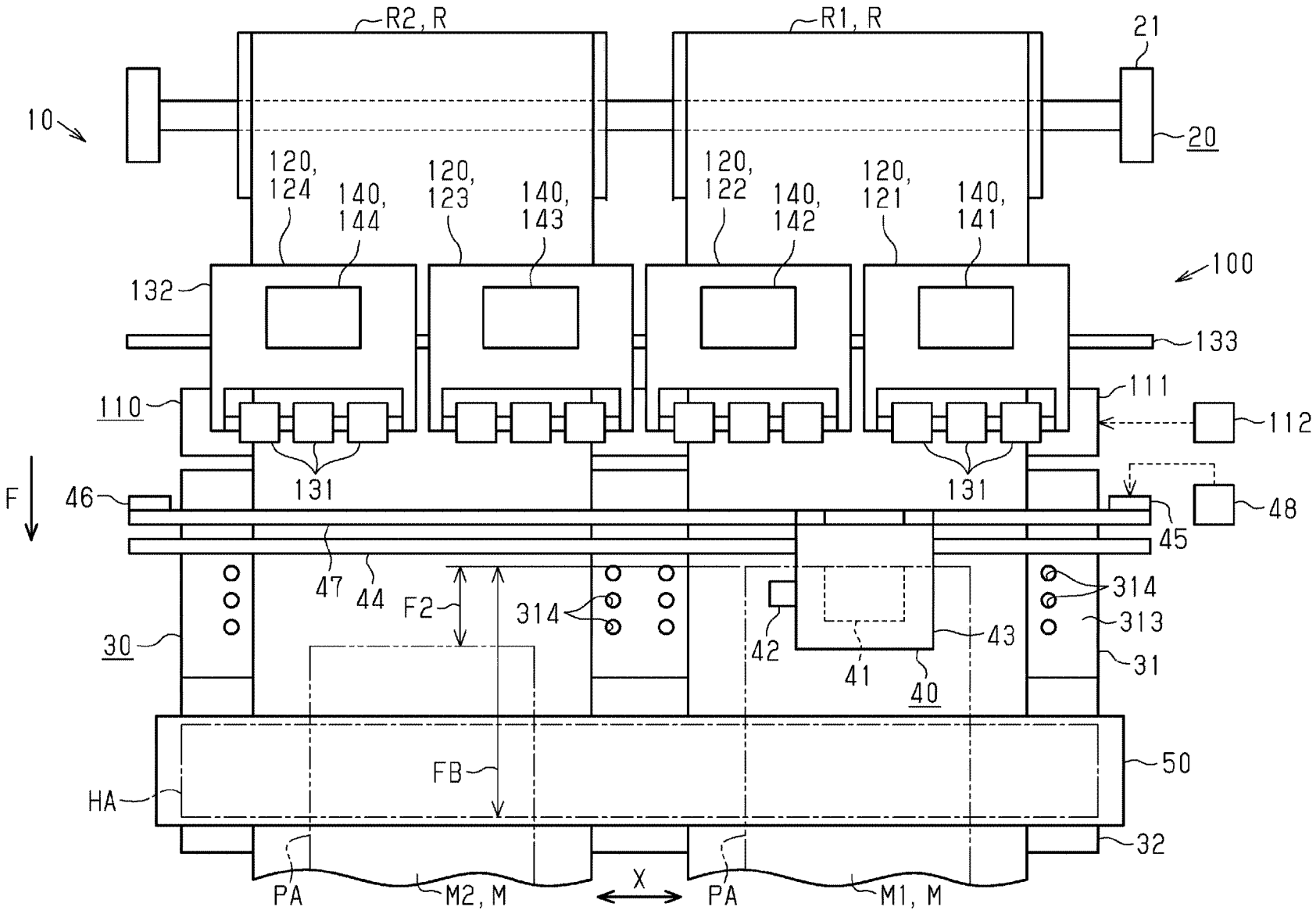

[Fig. 10]
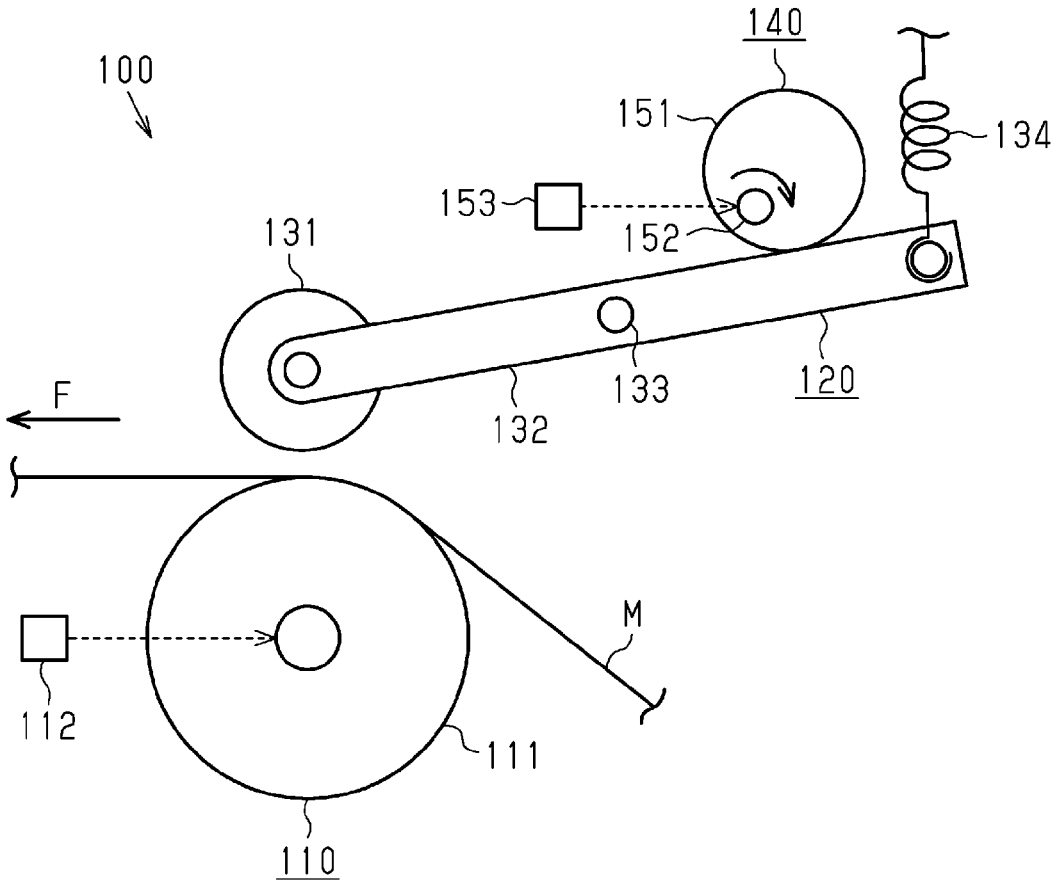

PRINTING APPARATUS

CROSS-REFERENCE TO RELATED APPLICATIONS

The present application claims priority to Japanese patent Application No. 2015-149343 filed on Jul. 29, 2015, which is hereby incorporated by reference in its entirety.

TECHNICAL FIELD

The present invention relates to a printing apparatus such as an ink jet printer.

BACKGROUND ART

In the related art, a printing apparatus is known which is provided with a holding unit (shaft) which holds a roll body on which a medium such as a paper sheet is wound in a cylindrical shape, a transport unit (transport roller) which transports the medium that is unwound from the roll body, and a printing unit (printing head) which prints an image on the medium by discharging ink on the medium that is transported by the transport unit.

Within such printing apparatuses, there is an apparatus which is able to perform printing simultaneously on a plurality of mediums that are unwound from two roll bodies by lining up and holding the two roll bodies in the holding unit in a width direction (for example, PTL 1).

CITATION LIST

Patent Literature

[PTL 1]
JP-A-2003-326781

SUMMARY OF INVENTION

Technical Problem

Here, in the printing apparatus as described above, during printing, the transport unit simultaneously transports the two mediums which are unwound from the two roll bodies. For this reason, even in a case where printing on one medium is complete, in a case where printing on the other medium is not complete, a state is continued in which the one medium is transported accompanying the printing on the other medium being continued.

That is, in this case, regardless of whether printing on the one medium is complete, an amount of consumption of the one medium tends to be great due to the amount of transport of the one medium continuing to increase until printing is complete on the other medium. Here, after printing on the other medium is complete, it is considered that the one medium is rewound on the roll body, but in this case, printing efficiency tends to reduce due to a point in which time is necessary for rewinding the one medium on the roll body.

Here, the actual circumstances are not limited to a case where printing on the one medium is complete in advance, and even in a case where printing on the one medium is not performed such as in a case where printing on the one medium is temporarily stopped, the actual circumstances are generally common.

The present invention is carried out in consideration of the above circumstances. Accordingly, it is an object of the present invention to provide a printing apparatus which is able to suppress an increase in an amount of transport of a portion of a plurality of mediums in a case where printing on the portion of mediums is not performed when printing is performed on the plurality of mediums which are unwound from a plurality of roll bodies.

Solution to Problem

Hereinafter, means for solving the problem and operation effects thereof will be described.

A printing apparatus to solve the problem is provided with a holding unit which holds, so as to be rotatable, a plurality of roll bodies on which a medium is wound in a cylindrical shape, a transport device which has a transport unit that imparts a transport force in a transport direction by coming into contact with the medium that is unwound from the roll body which is held in the holding unit, a pressing unit which presses the medium toward the transport unit, and an adjustment unit which is able to adjust a pressing force of the pressing unit on the medium in each of a plurality of regions in a width direction that intersects with the transport direction, and is able to transport the plurality of mediums in the transport direction in a state of being lined up in the width direction, a printing unit which performs printing on the medium that is transported by the transport device, and a control unit which controls the adjustment unit such that when a state of the medium on which printing is performed is a printing state and the state of the medium on which printing is not performed is a non-printing state, pressing force on the medium that is in the non-printing state from the printing state is smaller than in the printing state.

According to the configuration above, after the plurality of mediums which are unwound from the plurality of roll bodies are transported by the transport device, printing is carried out by the printing unit. Here, in the case where a portion out of the plurality of mediums are in the non-printing state, pressing force on the medium that is in the non-printing state is smaller than the pressing force when in the printing state. As a result, the medium which is in the non-printing state tends not to be transported in the transport direction by reducing the transport force which is applied from the transport unit.

In this manner, according to the configuration above, even in a case where printing on the other medium is not performed in a state in which printing is continued on at least one medium out of the plurality of mediums, the other medium tends not to be transported in the transport direction accompanying the printing on the one medium being continued. Accordingly, it is possible to suppress an increase in the amount of transport of the medium on which printing is not performed (medium in the non-printing state).

It is desirable that the printing apparatus is further provided with an acquiring unit which acquires length of the medium in the width direction, and that the control unit selects a region in which the pressing force on the adjustment unit is adjusted from within a plurality of regions in the width direction based on the length in the width direction of the medium that is in the non-printing state.

According to the configuration above, even in a case where printing is performed on a plurality of mediums on which the length is different in the width direction, the control unit is able to acquire the length of the medium in the width direction using the acquiring unit. As a result, the control unit is able to cause the adjustment unit to appropriately adjust the pressing force on the medium regardless of the length in the width direction of the medium in the non-printing state.

It is desirable that the printing apparatus is further provided with a transport resistance application unit which applies transport resistance to the medium in the non-printing state out of the plurality of mediums.

There is a concern that the medium is transported in the transport direction even if the transport force tends not to be applied to the medium due to the pressing force being small on the medium in the non-printing state. In this point, according to the configuration above, since transport resistance (force in the opposite direction to the transport direction) is applied to the medium in the non-printing state, the medium tends not to be transported in the transport direction. Accordingly, it is possible to further suppress an increase in the amount of transport of the medium in the non-printing state.

It is desirable that the printing apparatus is further provided with a support unit which supports the medium by adsorbing the medium which is transported by the transport device.

According to the configuration above, since the support unit adsorbs the medium, it is possible for the printing unit to perform printing on the medium which has a stable posture. Meanwhile, the medium tends not to be transported in the transport direction by the support unit adsorbing the medium. That is, according to the configuration, since the support unit functions as the transport resistance application unit which applies the transport resistance to the medium, it is not necessary to separately provide the transport resistance application unit.

In addition, in a case where the support unit does not adsorb the medium, when the pressing force on the medium is reduced in the non-printing state, there is a concern that the medium that is lifted from the support unit comes into contact with the printing unit due to the medium tending to lift up from the transport unit. In this point, in the configuration above, even if the medium tends to lift up from the transport unit in the non-printing state since the support unit adsorbs the medium, it is possible to suppress the medium from coming into contact with the printing unit since the medium tends not to lift up from the support unit.

It is desirable that the printing apparatus is further provided with a heating unit which heats the medium on the downstream side in the transport direction more than the printing unit, and that when a region in which printing is performed on the medium is a printed region and a region in which the heating unit heats the medium is a heating region, the control unit controls the adjustment unit such that the pressing force on the medium is reduced after the printed region of the medium in the non-printing state passes through the heating region.

An image which may be printed on the medium is fixed on the medium by heating the printed region of the medium using the printing apparatus by the heating unit that is provided further on the downstream side in the transport direction than the printing unit. Here, in such a printing apparatus, when pressing force on the medium in the non-printing state is reduced at a timing in the non-printing state, there is a concern that quality of the image that is printed on the medium is deteriorated by the printed region of the medium in the non-printing state remaining in the heating region. In this point, according to the configuration above, it is possible to suppress deterioration of the quality of the image which is printed on the medium in the non-printing state since the pressing force on the medium is not reduced until the printed region of the medium in the non-printing state passes through the heating region.

In the printing apparatus, it is desirable that the control unit adjusts the pressing force on the plurality of mediums based on the type of the plurality of mediums.

According to the type of medium, there are mediums to which the transport unit tends to apply transport force, and there are also mediums to which the transport unit tends not to apply the transport force. For this reason, in a case where the plurality of mediums which are different types are transported, when the pressing force on the plurality of mediums is equal, in the plurality of mediums, there may be times when differences in the amount of transport are generated, a degree to which wrinkles are generated may be changed, and a portion of mediums may change shape. According to the configuration above, since the pressing force on the medium is adjusted based on the type of medium, in a case where the plurality of mediums are simultaneously transported, it is possible to suppress generation of the situation described above.

BRIEF DESCRIPTION OF DRAWINGS

FIG. 1 is a side view illustrating an outline configuration of a printing apparatus according to an embodiment.

FIG. 2 is a planar view illustrating an outline configuration of the printing apparatus.

FIG. 3 is a front surface view illustrating an outline configuration of a detecting unit.

FIG. 4 is a side view illustrating an outline configuration of a transport device in which a driven roller is arranged at a pressing position.

FIG. 5 is a block diagram illustrating an electrical configuration of the printing apparatus.

FIG. 6 is a flow chart illustrating a process routine which is carried out by a control unit in order to perform printing.

FIG. 7 is a flow chart illustrating a first printing process routine.

FIG. 8 is a flow chart illustrating a second printing process routine.

FIG. 9 is a planar view illustrating an outline configuration of the printing apparatus when printing on a second medium is complete.

FIG. 10 is a side view illustrating an outline configuration of a transport device in which a driven roller is arranged at a non-pressing position.

DESCRIPTION OF EMBODIMENT

An embodiment of a printing apparatus will be described below with reference to the drawings. Here, the printing apparatus of the present embodiment is an ink jet type large format printer which prints an image on a long medium by ejecting ink on the medium which is unwound from a roll body. In addition, the image in the embodiment is not only the image such as a photo or drawing, but also includes text, a table, a graphic, or the like.

As shown in FIG. 1, a printing apparatus 10 is provided with a feeding unit 20 which feeds a medium M from a roll body R along a movement direction of the medium M, a transport device 100 which transports the medium M, a support unit 30 which supports the medium M, a printing unit 40 which performs printing on the medium M, and a heating unit 50 which heats the medium M.

Here, as per the following description, in FIG. 1, a direction which is orthogonal to a paper surface is a width direction X (refer to FIG. 2), and a movement direction of the medium M which is from the feeding unit 20 toward the heating unit 50 is a transport direction F. In addition, in the embodiment, one end (right end in FIG. 2) in the width direction X is a "first end", and another end (left end in FIG. 2) in the width direction X is a "second end".

As shown in FIGS. 1 and 2, the feeding unit 20 has a holding unit 21 which rotatably holds a plurality (two in the embodiment) of roll bodies R on which the medium M is wound in a cylindrical shape. As shown in FIG. 2, the holding unit 21 holds a first roll body R1 on which a first medium M1 is wound on a first end side in the width direction X, and holds a second roll body R2 on which a second medium M2 is wound on a second end side in the width direction X. In addition, the holding unit 21 holds the plurality of roll bodies R so as to be able to rotate at different rotation speeds. Then, the feeding unit 20 feeds the medium M from which the roll bodies R are unwound by permitting rotation of the roll bodies R in one direction (counterclockwise direction in FIG. 1) during transport of the medium M.

As shown in FIGS. 1 and 2, the support unit 30 is provided with a first support unit 31 which supports the medium M on the upstream side in the transport direction, and a second support unit 32 which supports the medium M on the downstream side in the transport direction. The first support unit 31 is provided in a region which faces the printing unit 40 and the second support unit 32 is provided in a region which faces the heating unit 50.

As shown in FIG. 1, the first support unit 31 has a closed space 311 and a pressure reducing mechanism 312 which reduces pressure in the closed space 311. In addition, in the first support unit 31, a suction hole 314 which links with the closed space 311 is formed to pass through a support surface 313 side on which the medium M is supported. As shown in FIG. 2, a plurality of suction holes 314 are formed so as to be lined up in the width direction X and the transport direction F in the first support unit 31. Here, in FIG. 2, the suction holes 314 are also formed in a region concealed in the medium M.

In addition, it is desirable that the support surface 313 of the first support unit 31 has a reflectance difference when comparing to the medium M which is supported by the first support unit 31. For example, in a case where the medium M is white, it is desirable that the support surface 313 of the first support unit 31 is black.

In this manner, the first support unit 31 adsorbs the medium M which is transported by the transport device 100 to the support surface 313 via the suction holes 314 by driving the pressure reducing mechanism 312, and stabilizes a posture of the medium M during printing. In addition, the second support unit 32 guides the medium M on which printing by the printing unit 40 is complete to the downstream side in the transport direction.

Here, when the medium M is transported, a case in which the medium M is adsorbed by the first support unit 31 on the support surface 313 tends not to transport the medium M more than a case in which the medium M is not adsorbed by the first support unit 31 on the support surface 313. In the embodiment, such a point is equivalent to an example of a "transport resistance applying unit" which applies transport resistance to the medium M using the first support unit 31 to which the medium M is adsorbed.

As shown in FIGS. 1 and 2, the printing unit 40 is provided with a discharge unit 41 (discharge head) which discharges ink, a detecting unit 42 which is able to detect the medium M that is supported on the support unit 30, a carriage 43 which supports the discharge unit 41 and the detecting unit 42, and a guide shaft 44 which supports the carriage 43 to be able to reciprocally move in the width direction X. In addition, as shown in FIG. 2, the printing unit 40 is provided with a drive pulley 45 which is provided on a first end side in the width direction X, a driven pulley 46 which is provided on a second end side in the width direction X, a timing belt 47 which is wound on the drive pulley 45 and the driven pulley 46, and a carriage motor 48 which drives the drive pulley 45.

As shown in FIG. 3, the detecting unit 42 has a light projecting unit 421 which projects light toward a detection object (support unit 30 and medium M which is supported on the support unit 30) and a light receiving unit 422 which receives light that is reflected from the detection object. For example, light which is transmitted from the light projecting unit 421 may be infrared or the like.

Then, the printing unit 40 performs printing on the medium M which is transported from the transport device 100 based on a print job which is introduced to the printing apparatus 10 from a user. In detail, the printing unit 40 rotates the timing belt 47 which is wound on the drive pulley 45 and the driven pulley 46 by driving the carriage motor 48, and moves the carriage 43 which is connected to the timing belt 47 in the width direction X. In addition, when the carriage 43 is moved in the width direction X, the printing unit 40 performs printing on the medium M by discharging ink from the discharge unit 41 on the medium M which is supported on the first support unit 31.

Here, the print job is a print command in which information that relates to printing content such as the image that is to be printed on the medium M and information which relates to printing conditions for printing the image at a position, size, or range are included.

In addition, when the carriage 43 is moved in the width direction X, the printing unit 40 projects light toward the detection object and receives reflected light from the detection object in the detecting unit 42. In this manner, the detecting unit 42 detects distribution of an amount of light reception with respect to a detection position in the width direction X. The amount of light reception is high in a case where reflectance at the detection position is high and is low in a case where reflectance at the detection position is low.

As shown in FIGS. 1 and 2, the picture which is printed on the medium M is fixed on the medium M due to the heating unit 50 heating the medium M which is transported on the second support unit 32. Here, as shown in FIG. 2, in the region in which the medium M is transported, a region in which the heating unit 50 performs heating is set as a heating region HA. In addition, as per the following description, as shown in FIG. 2, in the transport direction F, a distance along a transport path from the rear end of the discharge unit 41 of the printing unit 40 to a front end of the heating region HA is a "reference transport amount FB". That is, when the medium M is transported by the reference transport amount FB in the transport direction F from a timing at which printing on the medium M is complete, an image which is printed on the medium M finishes passing through the heating region HA of the heating unit 50.

Next, the transport device 100 will be described with reference to FIGS. 2 and 4.

As shown in FIGS. 2 and 4, the transport device 100 has a transport unit 110 in which transport force is applied to the medium M by coming into contact with the medium M that is unwound from the roll body R, a pressing unit 120 which presses the medium M toward the transport unit 110, and an adjustment unit 140 which is able to adjust force (pressing force) in which the pressing unit 120 presses the medium M toward the transport unit 110.

As shown in FIG. 2, the transport unit 110 has a transport roller 111 with a cylindrical shape in which the width direction X is a longitudinal direction and a transport motor 112 which transports the transport roller 111. Then, the transport unit 110 applies transport force to the medium M by rotating the transport roller 111 in a state of coming into contact with a rear surface of the medium M.

As shown in FIG. 2, the pressing unit 120 is provided in a plurality (four in the embodiment) of regions so as to line up in the width direction X. In detail, a first pressing unit 121, a second pressing unit 122, a third pressing unit 123, and a fourth pressing unit 124 are provided in the width direction X from the first end toward the second end. In this manner, the plurality of pressing units 120 presses the medium M toward the transport roller 111 in each of the plurality of regions in the width direction X.

In addition, as shown in FIGS. 2 and 4, the pressing unit 120 has a plurality (three in the embodiment) of driven rollers 131 with a cylindrical shape in which the width direction X is a longitudinal direction, a pressing plate 132 which supports the plurality of driven rollers 131 to be rotatable, a swing shaft 133 which supports the pressing plate 132 to freely swing, and a spring 134 which biases the pressing plate 132. Here, on the pressing plate 132, an upstream side end unit in the transport direction F is a "reference unit", and a downstream side end unit in the transport direction F is a "leading end unit".

As shown in FIG. 4, the plurality of driven rollers 131 are supported so as to be lined up in the width direction X in the leading end unit of the pressing plate 132. In addition, the swing shaft 133 passes through the substantial center between the leading end unit and base end unit of the pressing plate 132 in the width direction X. In this manner, the pressing plate 132 causes the driven roller 131 to come close to and move away from the transport roller 111 by swinging the swing shaft 133 about a swing center. Here, the swing shaft 133 may be provided separately in each of the plurality of pressing units 120, and may be provided in one with respect to the plurality of pressing units 120.

In addition, the spring 134 is a so-called tension coil spring. The spring 134 generates a moment of counterclockwise rotation on the pressing plate 132 in FIG. 4 with the swing shaft 133 as the center by raising tension vertically above the base end unit of the pressing plate 132. That is, the spring 134 generates a moment on the pressing plate 132 in order to press the driven roller 131 on the transport roller 111.

As shown in FIG. 2, a plurality (four in the embodiment) adjustment units 140 are provided corresponding to the plurality of pressing units 120 so as to line up in the width direction X. In detail, a first adjustment unit 141, a second adjustment unit 142, a third adjustment unit 143, and a fourth adjustment unit 144 are provided in the width direction X from the first end toward the second end.

As shown in FIG. 4, the adjustment unit 140 is provided with an adjustment cam 151 which adjusts an amount of swing of the pressing plate 132, a rotary shaft 152 which integrally rotates with the adjustment cam 151 at a position which is eccentric from a center of the adjustment cam 151, and an adjustment motor 153 which rotates the rotary shaft 152. Viewed from a side surface of the transport device 100 which is illustrated in FIG. 4, the adjustment cam 151 comes into contact with the pressing plate 132 from vertically above further on the base end side than the swing center of the pressing plate 132.

Then, as shown by the solid line arrow in FIG. 4, in the adjustment unit 140, the adjustment cam 151 changes the pressing force on the pressing plate 132 by eccentrically rotating the adjustment cam 151 with the rotary shaft 152 as the center. In this manner, the adjustment unit 140 adjusts the amount of swing about the swing shaft 133 of the pressing plate 132, and adjusts the pressing force on the medium M of the pressing unit 120. In addition, in the embodiment, it is possible to adjust the pressing force on the medium M in each of the plurality of regions in the width direction X by adjusting the pressing force of the plurality of pressing units 120 using the plurality of adjustment units 140.

Here, hereinafter in the description, a position of the driven roller 131 when the driven roller 131 (pressing unit 120) presses the medium M toward the transport roller 111 (transport unit 110) is also referred to as a "pressing position", and a rotation angle of the adjustment cam 151 which arranges the driven roller 131 at the pressing position is also referred to as a "first rotation angle". In addition, a position of the driven roller 131 when the driven roller 131 (pressing unit 120) does not press the medium M toward the transport roller 111 (transport unit 110) is also referred to as a "non-pressing position", and a rotation angle of the adjustment cam 151 which arranges the driven roller 131 at the non-pressing position is also referred to as a "second rotation angle". Here, in the embodiment, in a case where the driven roller 131 is arranged at the non-pressing position, the driven roller 131 does not come into contact with the medium M. That is, the pressing force on the medium M of the pressing unit 120 is "0 (zero)".

In this manner, the transport device 100 transports the plurality of mediums M in the transport direction F in a state of being lined up in the width direction X by rotating the transport roller 111 in a state where the driven roller 131 presses the medium M toward the transport roller 111. Here, during transport of the medium M, the driven roller 131 drivably rotates along with transport of the medium M. In addition, a state in which the driven roller 131 presses the medium M toward the transport roller 111 is also a state in which the transport roller 111 and the driven roller 131 interpose the medium M.

Next, an electrical configuration of the printing apparatus 10 will be described with reference to FIG. 5.

As shown in FIG. 5, the printing apparatus 10 has a control unit 60 which integrally controls the device, a display unit 70 which displays various information of the printing apparatus 10, and an operating unit 80 which operates when the user of the printing apparatus 10 sends an instruction (for example, a printing instruction) to the printing apparatus 10. The control unit 60 is a micro computer which has a CPU, a ROM, a RAM, and the like. In addition, for example, the display unit 70 may be configured by a liquid crystal display and the like, and for example, the operating unit 80 may be configured from a plurality of buttons.

In addition, the detecting unit 42 and the operating unit 80 are connected to an input side interface of the control unit 60, and the discharge unit 41, the detecting unit 42, the carriage motor 48, the heating unit 50, the display unit 70, the transport motor 112, the adjustment motor 153, and the pressure reducing mechanism 312 are connected to an output side interface of the control unit 60. Then, the control unit 60 executes printing by controlling driving of each configuration which is connected to the output side interface based on information which is input from each configuration which is connected to the input side interface.

That is, the control unit 60 performs printing on the medium M by alternately performing a transport operation which transports the medium M by a predetermined amount in the transport direction F in the transport device 100 and a discharge operation which discharges ink from the discharge unit 41 while moving the carriage 43 in the width direction X so as to cut across the first medium M1 and the second medium M2. In addition, hereinafter in the description, on the medium M, the region in which the picture is printed is also referred to as a "printed region PA".

As in the printing apparatus 10 of the embodiment, the printing apparatus 10 which performs printing simultaneously on the first medium M1 and the second medium M2 which are transported lined up on the width direction X, printing on the first medium M1 and the second medium M2 end at different timings. That is, even in a case where printing on one medium M is complete, in a case where printing on the other medium M is not complete, the transport operation and the discharge operation are repeatedly performed in order to continue printing on the other medium M.

In addition, since the printing apparatus 10 of the embodiment simultaneously transports the first medium M1 and the second medium M2 by rotatably driving a single transport roller 111 using a single transport motor 112, even in a case where printing on one medium M is complete, in a case where printing on the other medium M continues, the amount of transport of the one medium M is gradually increased. That is, the amount of consumption of the medium M tends to be great unrelated to printing by transporting the one medium M which it is unnecessary to transport due to printing being complete. In addition, in a case where the medium M which is transported unrelated to printing is rewound on the roll body R, printing efficiency (throughput) tends to reduce due to a time being necessary for rewinding.

Therefore, in the embodiment, the adjustment unit 140 is controlled such that the pressing force of the pressing unit 120 on the medium M on which printing is complete is shorter than prior to printing on the medium M is complete. In detail, out of the plurality of pressing units 120, the adjustment cam 151 of the adjustment unit 140 which adjusts the pressing force of the pressing unit 120 that presses the medium M on which printing is complete is modified from the first rotation angle to the second rotation angle. Thereby, the medium M on which printing is complete tends not to be pressed on the transport roller 111 and tends not to be transported in the transport direction F by displacing the driven roller 131 which presses the medium M on which printing is complete from the pressing position to the non-pressing position.

In addition, if a state of the medium M on which printing is performed is a "printing state" and a state of the medium M on which printing is not performed is a "non-printing state", it is also possible to refer to adjustment of the adjustment unit 140 such that the pressing force of the pressing unit 120 on the medium M from the printing state to the non-printing state is smaller than in the printing state. That is, the non-printing state in the embodiment is a state of the medium M on which printing is complete.

Here, in a case where the driven roller 131 which presses the medium M on which printing is complete is displaced from the pressing position to the non-pressing position at a timing directly after which printing is complete, there are times when the printed region PA of the medium M on which printing is complete remains in the heating region HA. In this case, there is a concern that quality of the image which is printed in the printed region PA deteriorates by heating the printed region PA of the medium M on which printing is complete over a long time.

Therefore, in the embodiment, the adjustment unit 140 is controlled such that the pressing force of the pressing unit 120 on the medium M on which printing is complete is reduced after the printed region PA of the medium M on which printing is complete passes through the heating region HA. In detail, after the amount of transport of the medium M from the timing at which printing is complete is the reference transport amount FB or more, arrangement of the driven roller 131 which presses the medium M is displaced from the pressing position to the non-pressing position.

Next, a process routine which is carried out by a control unit 60 in order to execute printing on the medium M will be described with reference to flow charts which are illustrated in FIGS. 6 to 8. Here, with respect to the printing apparatus 10, the present process routine is a process routine which is carried out when the first roll body R1 and the second roll body R2 are set and the print job is introduced with respect to the first medium M1 and the second medium M2. That is, at the timing at which the present process routine is started, the first medium M1 and the second medium M2 are adsorbed to the first support unit 31 by being driven by the pressure reducing mechanism 312, and the heating region HA is heated due to being driven by the heating unit 50. In addition, the driven roller 131 of the plurality of pressing units 120 is arranged at all pressing positions.

As shown in FIG. 6, the control unit 60 acquires a length in the width direction X and a position in the width direction X of the first medium M1 and the second medium M2 based on the detection result of the detecting unit 42 (step S11). For example, in a case where the reflectance of the medium M is higher than the support surface 313 of the first support unit 31, in distribution of the amount of received light in the width direction X, a portion with a high amount of received light is equivalent to a region in which the first support unit 31 supports the medium M and a portion with a low amount of received light is equivalent to a region in which the first support unit 31 does not support the medium M. In this manner, the control unit 60 ascertains at what position of the first support unit 31 the medium M, which has a certain length, is supported in the width direction X based on the detection result of the detecting unit 42. In the embodiment, such a point is equivalent to an example of an "acquiring unit" which acquires the length of the medium M in the width direction X using the detecting unit 42.

In addition, accompanying execution of the present step S11, it is understood whether the first medium M1 and the second medium M2 are supported in a region in which some pressing unit 120 is arranged in the width direction X. For example, according to the printing apparatus 10 shown in FIG. 2, the control unit 60 recognizes that there is a pressing unit 120 in which the first pressing unit 121 and the second pressing unit 122 press the first medium M1 and recognizes that there is a pressing unit 120 in which the third pressing unit 123 and the fourth pressing unit 124 press the second medium M2. For this reason, in a case where the pressing force on the first medium M1 is adjusted, the control unit 60 adjusts the pressing force on the first adjustment unit 141 and the second adjustment unit 142, and in a case where the pressing force on the second medium M2 is adjusted, the control unit 60 adjusts the pressing force on the third adjustment unit 143 and the fourth adjustment unit 144.

Then, the printing unit 40 starts printing on the first medium M1 and the second medium M2 (step S12). That is, the control unit 60 alternately performs the transport operation which transports the medium M in the transport direction F and the discharge operation which discharges the ink toward the medium M. Here, in the transport operation, the first medium M1 and the second medium M2 are transported by an equal amount of transport. In addition, in the discharge operation, when the carriage 43 moves in the width direction X, while the discharge unit 41 faces the first medium M1, ink is discharged from the discharge unit 41 based on the print job on the first medium M1, and while the discharge unit 41 faces the second medium M2, ink is discharged from the discharge unit 41 based on the print job on the second medium M2.

Subsequently, the control unit 60 determines whether or not printing on the first medium M1 is totally complete (step S13), and in a case where printing on the first medium M1 is not totally complete (step S13: NO), the control unit 60 determines whether or not printing on the second medium M2 is totally complete (step S14). In a case where printing on the second medium M2 is not totally complete (step S14: NO), the control unit 60 transitions the process to step S13. That is, in this case, until printing is complete on at least one medium M out of the first medium M1 and the second medium M2, the process in steps S13 and S14 are repeatedly executed.

Meanwhile, in step S14, in a case where printing on the second medium M2 is totally complete (step S14: YES), the control unit 60 carries out a first printing process which is shown in FIG. 7 (step S15). The first printing process is a process which is carried out in a case where printing on the first medium M1 is continued under the circumstance in which printing on the second medium M2 is complete. Then, when the first printing process is carried out, the control unit 60 temporarily completes the present process routine.

Meanwhile, in step S13, in a case where printing on the first medium M1 is totally complete (step S13: YES), the control unit 60 determines whether or not printing on the second medium M2 is totally complete (step S16). In a case where printing on the second medium M2 is totally complete (step S16: YES), the control unit 60 temporarily completes the present process routine.

Meanwhile, in a case where printing on the second medium M2 is not totally complete (step S16: NO), the control unit 60 carries out a second printing process which is shown in FIG. 7 (step S17). The second printing process is a process which is carried out in a case where printing on the first medium M2 is continued under the circumstance in which printing on the second medium M1 is complete. Then, when the second printing process is carried out, the control unit 60 temporarily completes the present process routine.

Here, in the process routine, the case where printing on the first medium M1 is totally complete has a meaning of a case where the print job with respect to the first medium M1 is totally processed, and the case where printing on the second medium M2 is totally complete has a meaning of a case where the print job with respect to the second medium M2 is totally processed.

Subsequently, the first printing process routine in step S15 will be described with reference to FIG. 7. Here, as described above, a case in which the present process routine is carried out is a case where printing on the second medium M2 is totally complete.

As shown in FIG. 7, the control unit 60 determines whether or not printing on the first medium M1 is totally complete (step S21), and in a case where printing on the first medium M1 is totally complete (step S21: YES), the control unit 60 temporarily completes the present process routine.

Meanwhile, in a case where printing on the first medium M1 is not totally complete (step S21: NO), the control unit 60 acquires a second amount of transport F2 which is the amount of transport of the second medium M2 from a timing at which printing on the second medium M2 is complete (step S22). Here, the second amount of transport F2 is gradually increased by continuing printing on the first medium M1, that is, by repeating the transport operation.

Subsequently, the control unit 60 determines whether or not the second amount of transport F2 is a reference amount of transport FB or more (step S23), in a case where the second amount of transport F2 is less than the reference amount of transport FB (step S23: NO), the process transitions to step S21. That is, in this case, the printed region PA of the second medium M2 on which printing is complete does not yet pass through the heating region HA, and transport of the second medium M2 is not stopped.

Meanwhile, in a case where the second amount of transport F2 is the reference amount of transport FB or more (step S23: YES), the control unit 60 arranges the driven roller 131 which corresponds to the second medium M2, that is, the driven roller 131 which presses the second medium M2 on the non-pressing position (step S24). In detail, the control unit 60 displaces the driven roller 131 of the third pressing unit 123 and the fourth pressing unit 124 from the pressing position to the non-pressing position by rotating the adjustment cam 151 of the third adjustment unit 143 and the fourth adjustment unit 144 from the first rotation angle to the second rotation angle. In this manner, in this case, the printed region PA of the second medium M2 on which printing is complete passes through the heating region HA, and transport of the second medium M2 is stopped.

Then, the control unit 60 determines whether or not printing on the first medium M1 is totally complete (step S25), and in a case where printing on the first medium M1 is not totally complete (step S25: NO), the control unit 60 transitions the process to step S25. That is, the control unit 60 recursively executes the process of step S25 until printing on the first medium M1 is complete. Meanwhile, in a case where printing on the first medium M1 is totally complete (step S25: YES), the control unit 60 temporarily completes the present process routine.

Subsequently, the second printing process routine in step S17 will be described with reference to FIG. 8. Here, as described above, a case in which the present process routine is carried out is a case where printing on the first medium M1 is totally complete.

As shown in FIG. 8, the control unit 60 determines whether or not printing on the second medium M2 is totally complete (step S31), and in a case where printing on the second medium M2 is totally complete (step S31: YES), the control unit 60 temporarily completes the present process routine.

Meanwhile, in a case where printing on the second medium M2 is not totally complete (step S31: NO), the control unit 60 acquires the first amount of transport F1 which is the amount of transport of the first medium M1 from a timing at which printing on the first medium M1 is complete (step S32). Here, the first amount of transport F1 is gradually increased by continuing printing on the second medium M2, that is, by repeating the transport operation.

Subsequently, the control unit 60 determines whether or not the first amount of transport F1 is the reference amount of transport FB or more (step S33), in a case where the first amount of transport F1 is less than the reference amount of transport FB (step S33: NO), the process transitions to step S31. That is, in this case, the printed region PA of the first medium M1 on which printing is complete does not yet pass through the heating region HA, and transport of the first medium M1 is not stopped.

Meanwhile, in a case where the first amount of transport F1 is the reference amount of transport FB or more (step S33: YES), the control unit 60 arranges the driven roller 131 which corresponds to the first medium M1, that is, the driven roller 131 which presses the first medium M1 on the non-pressing position (step S34). In detail, the control unit 60 displaces the driven roller 131 of the first pressing unit 121 and the second pressing unit 122 from the pressing position to the non-pressing position by rotating the adjustment cam 151 of the first adjustment unit 141 and the second adjustment unit 142 from the first rotation angle to the second rotation angle. In this manner, in this case, the printed region PA of the first medium M1 on which printing is completed passes through the heating region HA, and transport of the first medium M1 is stopped.

Then, the control unit 60 determines whether or not printing on the second medium M2 is totally complete (step S35), and in a case where printing on the second medium M2 is not totally complete (step S35: NO), the control unit 60 transitions the process to step S35. That is, the control unit 60 recursively executes the process of step S35 until printing on the second medium M2 is complete. Meanwhile, in a case where printing on the second medium M2 is totally complete (step S35: YES), the control unit 60 temporarily completes the present process routine.

Next, actions of the printing apparatus 10 of the embodiment will be described with reference to FIGS. 2, 4, 9, and 10. Here, hereinafter in the description, a case will be described where printing is simultaneously performed on two mediums M which are unwound from two roll bodies R.

In the printing apparatus 10 of the embodiment, in a case where printing is performed, the medium M, which is unwound from two roll bodies R that are held in the holding unit 21, is supported on the support unit 30. Subsequently, as preparation prior to performing printing, the first medium M1 and the second medium M2 are adsorbed to the first support unit 31 due to driving of the pressure reducing mechanism 312, and temperature of the heating region HA on the second support unit 32 is raised due to driving of the heating unit 50.

Then, when the first medium M1 and the second medium M2 are supported on the first support unit 31, the length in the width direction X and the support position of the first medium M1 and the second medium M2 which are supported on the first support unit 31 are acquired by performing detection in the detecting unit 42 while moving the carriage 43 from the first end toward the second end in the width direction X.

In addition, in the transport unit 110, as shown in FIG. 4, the driven roller 131 is arranged at the pressing position by rotating the adjustment cam 151 of each adjustment unit 140 about the first rotation angle such that it is possible to transport the first medium M1 and the second medium M2 in the transport direction F. As a result, the first medium M1 is pressed by the driven roller 131 of the first pressing unit 121 and the second pressing unit 122, and the second medium M2 is pressed by the driven roller 131 of the third pressing unit 123 and the fourth pressing unit 124.

In this manner, when preparation for printing is made, printing on the first medium M1 and printing on the second medium M2 is started. That is, the transport operation which transports the first medium M1 and the second medium M2 in the transport direction F and a discharge operation which discharges ink from the discharge unit 41 on the first medium M1 and the second medium M2 while moving the carriage 43 in the width direction X are alternately performed. In addition, the first medium M1 and the second medium M2 on which printing is performed are transported further to the downstream side in the transport direction than the printing unit 40, and pass through the heating region HA. In this manner, an image which is printed on the first medium M1 and the second medium M2 is fixed on the first medium M1 and the second medium M2 by heating the printed region of the first medium M1 and the second medium M2.

Here, as shown in FIG. 9, while printing on the first medium M1 continues, printing on the second medium M2 is complete. In this case, the first medium M1 and the second medium M2 are transported accompanying printing on the first medium M1 being continued until the printed region PA of the second medium M2 passes through the heating region HA. Then, when the printed region PA of the second medium M2 passes through the heating region HA, due to the second amount of transport F2 being the reference amount of transport FB or more after printing on the second medium M2 is complete, the pressing force of the pressing unit 120 on the second medium M2 is adjusted so as to be reduced.

That is, as shown in FIG. 10, the adjustment cam 151 of the third adjustment unit 143 and the fourth adjustment unit 144 rotates about the second rotation angle, and the driven roller 131 of the third pressing unit 123 and the fourth pressing unit 124 which press the second medium M2 is arranged on the non-pressing position.

As a result, the driven roller 131 of the third pressing unit 123 and the fourth pressing unit 124 does not press the second medium M2, and transport force which is applied to the second medium M2 from the transport roller 111 is reduced due to the second medium M2 not being pressed by the transport roller 111. In addition, in the embodiment, since the first medium M1 and the second medium M2 are adsorbed to the support unit 30, transport resistance in which the first medium M1 and the second medium M2 tend not be transported in the transport direction F is applied to the first medium M1 and the second medium M2. Accordingly, when the driven roller 131 which presses the second medium M2 is arranged at the non-pressing position, the second medium M2 is not transported in the transport direction F.

In this manner, while printing on the first medium M1 continues, in a case where printing on the second medium M2 is complete, transport of the second medium M2 in the transport direction F is restricted while transport of the first medium M1 in the transport direction F is permitted. Accordingly, wasteful consumption of the second medium M2 and reduction of printing efficiency due to the second medium M2 which is transported in the transport direction F being rewound on the second roll body R2 are suppressed by transporting the second medium M2 in the transport direction F unrelated to printing.

According to the embodiment described above, it is possible to obtain the effects indicated below.

(1) In a case where printing on one medium M is completed in advance, the pressing force of the pressing unit 120 on the medium M on which printing is completed in advance is smaller than the pressing force of the pressing unit 120 prior to printing being complete. As a result, the medium M on which printing is completed in advance tends not to be transported in the transport direction F by reducing the transport force which is applied from the transport roller 111. Accordingly, in a case where printing is complete on one medium M (second medium M2) and printing on the other medium M (first medium M1) is not complete, it is possible to suppress an increase in an amount of transport of one medium M by continuing printing on the other medium M.

(2) Since the length of the medium M in the width direction X is acquired based on the detection result of the detecting unit 42, regardless of the length in the width direction X of the medium M on which printing is completed, the control unit 60 is able to appropriately adjust pressing force of the pressing unit 120 on the medium M. In addition, it is possible to reduce a burden on the user in comparison to a case where the length of the medium M in the width direction X is input to the user.

(3) There is a concern that even if the pressing force of the pressing unit 120 on the medium M on which printing is complete is small, the medium M on which printing is complete is transported in the transport direction F due to the transport force being applied on the medium M. In this point, according to the embodiment, since transport resistance (force in the opposite direction to the transport direction F) is applied to the medium M on which printing is complete, the medium M tends not to be transported in the transport direction F due to the first support unit 31 being adsorbed to the medium M. Accordingly, it is possible to further suppress an increase in the amount of transport of the medium M on which printing is complete in advance.

(4) The first support unit 31 is provided in order to stabilize a posture of the medium M by adsorbing the medium M, but also functions as the "transport resistance application unit" as described above. For this reason, in a portion in which it is not necessary to separately provide the transport resistance application unit, it is possible to simplify the configuration of the printing apparatus 10.

In addition, the first support unit 31 is provided in a region which faces a movement region of the carriage 43, and supports by adsorbing the medium M on which ink is discharged. For this reason, the medium M is suppressed from lifting up from the first support unit 31 even if the medium M tends to raise up from the transport roller 111 by reducing the pressing force on the medium M on which printing is complete in advance. In this manner, it is possible to suppress the discharge unit 41 and the carriage 43 which move the medium M on which printing is complete in advance in the width direction X from coming into contact.

(5) Since the driven roller 131 which presses the medium M on which printing is complete is not displaced from the pressing position to the non-pressing position until the printed region PA of the medium M on which printing is complete passes through the heating region HA, it is possible to suppress the printed region PA of the medium M on which printing is complete from remaining in the heating region HA. As a result, it is possible to suppress deterioration of quality of the image which is printed on the medium M.

Here, the embodiment may be modified as shown below.

For example, in a case where the plurality of mediums M which are different types are transported, when the pressing force of the pressing unit 120 on the plurality of mediums M is equal, in the plurality of mediums M, there are times when differences in the amount of transport are generated and an aspect in which wrinkles are generated during transport changes. Meanwhile, according to the transport device 100 of the embodiment which is shown in FIG. 4, it is possible to change the amount of swing about the swing shaft 133 of the pressing plate 132 and adjust pressing force of the pressing unit 120 on the medium M by adjusting the amount of rotation of the adjustment cam 151 of the adjustment unit 140.

Therefore, the control unit 60 may adjust pressing force of the pressing unit 120 based on the type of the plurality of mediums M. In detail, in a case where printing is performed simultaneously on a slippery medium M (for example, a resin film) and a non-slippery medium M (for example, paper), while the pressing force of the pressing unit 120 which presses the slippery medium M may be large and the pressing force of the pressing unit 120 which presses the non-slippery medium M may be small. Thereby, in a case where the plurality of mediums M with different slipperiness are transported, it is possible to set variance of transport of each medium M. In addition, pressing force of the pressing unit 120 may be adjusted according to ease of marking and the like of the driven roller 131 and ease of change of shape of the medium M.

In the embodiment, four pressing units 120 are provided in the width direction X, but two pressing units 120 may be provided in the width direction X, three may be provided in the width direction, and five or more may be provided in the width direction. In addition, the lengths in the width direction X of the plurality of pressing units 120 need not all be equal. For example, the length in the width direction X may be shortened from a first end side toward the second end side in the width direction X.

In the printing apparatus 10 in the embodiment, four pressing units 120 are provided in the width direction X and printing is performed simultaneously on two mediums M, but in the printing apparatus 10, printing may be performed on one medium M, and printing may be performed simultaneously on three or four mediums M. Here, the maximum number of mediums M on which the printing apparatus 10 is able to perform printing simultaneously is equal to the number of pressing units 120.

The driven roller 131 which presses the medium M on which printing is complete may be displaced from the pressing position to the non-pressing position at a timing directly after which printing is complete. That is, before the printed region PA of the medium M on which printing is completed passes through the heating region HA, transport of the medium M may be stopped. However, in this case, since there is a concern that the image which is printed in the printed region PA deteriorates due to the printed region PA of the medium M on which printing is complete remaining in the heating region HA, it is desirable to use ink with high heat resistance (image forming material).

The heating unit 50 need not be provided. In this case, in order to suppress an increase of the amount of transport of the medium M on which printing is complete, it is desirable that the driven roller 131 which presses the medium M on which printing is complete is displaced from the pressing position to the non-pressing position at a timing directly after which printing is complete.

In the embodiment, in a case where printing on a portion of the mediums M out of a plurality of mediums M is complete, the adjustment unit 140 is controlled such that the pressing force of the pressing unit 120 on the medium M is shorter than prior to printing being complete, but in another case, the adjustment unit 140 may be controlled. For example, in a case where printing on the portion of the mediums M out of the plurality of mediums M is temporarily stopped (the print job is suspended) due to an instruction from the user, generation of transport failure, and the like, the adjustment unit 140 may be controlled such that the pressing force of the pressing unit 120 on the medium M is shorter than prior to printing being stopped. Here, in this case, in place of the medium M on which printing is complete, a state of the medium M on which printing is stopped is equivalent to a "non-printing state".

In addition, in a case where after the adjustment unit 140 is controlled such that the pressing force of the pressing unit 120 on the medium M on which printing is temporarily stopped is shorter than prior to printing being complete and printing on the medium M resumes, it is desirable that pressing force of the pressing unit 120 on the medium M on which printing is resumed controls the adjustment unit 140 so as to be equal prior to printing being stopped.

The transport resistance application unit may apply transport resistance to the medium M by interposing the medium M which is unwound from the roll body R from the front surface to the rear surface, and may apply transport resistance to the medium M which is unwound from the roll body R by applying braking force on the roll body R.

In the embodiment, in order to adjust the pressing force of the pressing unit 120, the plurality of adjustment cams 151 and a plurality of adjustment motors 153 which drive the plurality of adjustment cams 151 are provided, but the plurality of adjustment cams 151 may be driven by a single adjustment motor by modifying the shape of the plurality of adjustment cams 151. In addition, the pressing force of the pressing unit 120 may be adjusted by a mechanism other than a cam.

In the embodiment, the pressing force of the pressing unit 120 is set to "0 (zero)" by arranging the driven roller 131 which presses the medium M on which printing is complete to the non-pressing position, but need not be set thereto. That is, the driven roller 131 which presses the medium M on which printing is complete may be displaced from the first pressing position to a second pressing position at which the pressing force is smaller than at the first pressing position. Even using this configuration, in order to be able to reduce the pressing force of the pressing unit 120 on the medium M it is possible to obtain the effect (1) of the embodiment by displacement from the first pressing position to the second pressing position of the driven roller 131.

The transport roller 111 as an example of the transport unit 110 may be a transport belt. That is, the transport unit 110 may apply transport force to the medium M by rotating the width direction X as a rotary shaft in a state of being in contact with the medium M.

The pressing unit 120 need not be provided with the driven roller 131. In this case, the pressing plate 132 presses the medium M toward the transport roller 111.

The detecting unit 42 need not be provided in the carriage 43. For example, there may be a line center which is embedded across the width direction X in the first support unit 31. In addition, the detecting unit 42 need not be a reflective photoelectric sensor.

The detecting unit 42 need not be provided as an example of the acquiring unit. In this case, it is desirable that the length in the width direction X of the medium M is input via the operating unit 80 to the user. That is, in this case, the operating unit 80 is equivalent to an example of the acquiring unit.

In a case where the length in the width direction X of the roll body R which is set in the printing apparatus 10 is a predetermined length (for example, 64 inches), the acquiring unit need not be provided.

The support unit 30 (first support unit 31) need not have the pressure reducing mechanism 312. In this case, the medium M is only placed in the first support unit 31.

The printing apparatus 10 may not be provided with the carriage 43, may be provided with the discharge unit 41 which is fixed in an elongated shape which corresponds to the entire width of the medium M, and may be modified to the printing apparatus 10 of a so-called full-line type. In the discharge unit 41 in this case, the print range may be across the entire width of the medium M by arranging in parallel a plurality of unit heads on which nozzles are formed and the print range may be across the entire width of the medium M by arranging multiple nozzles so as to be across the entire width of the medium M in a single elongated head.

The printing apparatus 10 is not limited to a printer which performs recording by ejecting fluid such as ink, for example, the printing apparatus 10 may be a non-impact printer such as a laser printer, an LED printer, and a thermal transfer printer (including a dye-sublimation printer), and may be an impact printer such as a dot impact printer.

The medium M is not limited to a paper sheet, and may be a plastic film, thin plate material, and the like, and may be a fabric which is used in a printing apparatus and the like.

REFERENCE SIGNS LIST

10 PRINTING APPARATUS
20 FEEDING UNIT
21 HOLDING UNIT
30 SUPPORT UNIT
31 FIRST SUPPORT UNIT
311 CLOSED SPACE
312 PRESSURE REDUCING MECHANISM
313 SUPPORT SURFACE
314 SUCTION HOLE
32 SECOND SUPPORT UNIT
40 PRINTING UNIT
41 DISCHARGE UNIT
42 DETECTING UNIT
421 LIGHT PROJECTING UNIT
422 LIGHT RECEIVING UNIT
43 CARRIAGE
44 GUIDE SHAFT
45 DRIVE PULLEY
46 DRIVEN PULLEY
47 TIMING BELT
48 CARRIAGE MOTOR
50 HEATING UNIT
60 CONTROL UNIT
70 DISPLAY UNIT
80 OPERATING UNIT
100 TRANSPORT DEVICE
110 TRANSPORT UNIT
111 TRANSPORT ROLLER
112 TRANSPORT MOTOR
120 (121-124) PRESSING UNIT
131 DRIVEN ROLLER
132 PRESSING PLATE
133 SWING SHAFT
134 SPRING

140 (141 to 144) ADJUSTMENT UNIT
151 ADJUSTMENT CAM
152 ROTARY SHAFT
153 ADJUSTMENT MOTOR
F TRANSPORT DIRECTION
F1 FIRST AMOUNT OF TRANSPORT
F2 SECOND AMOUNT OF TRANSPORT
FB REFERENCE TRANSPORT AMOUNT
HA HEATING REGION
M MEDIUM
M1 FIRST MEDIUM
M2 SECOND MEDIUM
R ROLL BODY
R1 FIRST ROLL BODY
R2 SECOND ROLL BODY
PA PRINTED REGION
X WIDTH DIRECTION

The invention claimed is:

1. A printing apparatus comprising:
a holding unit configured to hold, so as to be rotatable, a plurality of roll bodies on which a medium is wound in a cylindrical shape;
a transport device comprising:
a transport roller configured to impart a transport force in a transport direction by coming into contact with the medium that is unwound from the roll body which is held in the holding unit,
a pressing unit configured to press the medium toward the transport roller, and
an adjustment unit configured to adjust a pressing force of the pressing unit on the medium in each of a plurality of regions in a width direction that intersects with the transport direction, the transport device being configured to transport the plurality of media in the transport direction in a state of being lined up in the width direction;
a printing unit configured to perform printing on the medium that is transported by the transport device; and
a control unit configured to control the adjustment unit such that the pressing force on the medium that is in a non-printing state is smaller than the pressing force on the medium that is in a printing state.

2. The printing apparatus according to claim 1, further comprising:
an acquiring unit configured to acquire a length of the medium in the width direction,
wherein the control unit is configured to select a region in which the pressing force is adjusted by the adjusting unit out of a plurality of regions in the width direction based on the length in the width direction of the medium that is in the non-printing state.

3. The printing apparatus according to claim 1 or 2, further comprising:
a transport resistance application unit configured to apply transport resistance on the medium in the non-printing state out of the plurality of mediums.

4. The printing apparatus according to claim 3, further comprising:
a support unit which is configured to support the medium by adsorbing the medium which is transported by the transport device.

5. The printing apparatus according to claim 1, further comprising:
a heating unit configured to heat the medium on the downstream side of the printing unit in the transport direction,
wherein the control unit is configured to control the adjustment unit such that the pressing force on the medium is reduced after the printed region of the medium in the non-printing state passes through a heating region in which the heating unit heats the medium.

6. The printing apparatus according to claim 1,
wherein the control unit is configured to adjust the pressing force on the plurality of mediums based on the type of the plurality of mediums.

7. A printing apparatus comprising:
a holding unit configured to hold, so as to be rotatable, a plurality of roll bodies on which a medium is wound in a cylindrical shape;
a transport device comprising:
a transport roller configured to impart a transport force in a transport direction by coming into contact with the medium,
a pressing unit configured to press the medium toward the transport roller, and
an adjustment unit configured to adjust a pressing force of the pressing unit on the medium in each of a plurality of regions in a width direction that intersects with the transport direction, the transport device being configured to transport the plurality of media in the transport direction in a state of being lined up in the width direction; and
a control unit configured to control the adjustment unit so as to adjust the pressing force corresponding to each of the plurality of regions individually in the width direction, based on a type of each medium corresponding to each of the plurality of regions.

8. The printing apparatus according to claim 7, further comprising:
a printing unit configured to perform printing on the medium that is transported by the transport device,
wherein the control unit configured to control the adjustment unit such that the pressing force on the medium that is in a non-printing state is smaller than the pressing force on the medium that is in a printing state.

9. The printing apparatus according to claim 8, further comprising:
an acquiring unit configured to acquire a length of the medium in the width direction,
wherein the control unit is configured to select a region in which the pressing force unit is adjusted by the adjusting unit out of a plurality of regions in the width direction based on the length in the width direction of the medium that is in the non-printing state.

10. The printing apparatus according to claim 8 or 9, further comprising:
a transport resistance application unit configured to apply transport resistance on the medium in the non-printing state out of the plurality of mediums.

11. The printing apparatus according to claim 10, further comprising:
a support unit configured to support the medium by adsorbing the medium which is transported by the transport device.

12. The printing apparatus according to claim 7, further comprising:
a heating unit configured to heat the medium on the downstream side of the printing unit in the transport direction,
wherein the control unit is configured to control the adjustment unit such that the pressing force on the medium is reduced after a printed region of the medium in the non-printing state passes through a heating region in which the heating unit heats the medium.

13. The printing apparatus according to claim 7, wherein the control unit is configured to adjust the pressing force based on slipperiness of the medium in each of the plurality of regions.

14. The printing apparatus according to claim 7, wherein the control unit is configured to adjust the pressing force based on ease of change of shape of the medium in each of the plurality of regions.

* * * * *